US006668906B2

(12) United States Patent
Burd

(10) Patent No.: US 6,668,906 B2
(45) Date of Patent: Dec. 30, 2003

(54) SHAPED CORE FOR CAST COOLING PASSAGES AND ENHANCED PART DEFINITION

(75) Inventor: Steven W. Burd, Cheshire, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 10/135,059

(22) Filed: Apr. 29, 2002

(65) Prior Publication Data

US 2003/0201089 A1 Oct. 30, 2003

(51) Int. Cl.[7] ..... B22C 9/10; B22B 7/28; B22B 7/34

(52) U.S. Cl. ..... 164/302; 164/369; 249/175; 249/135

(58) Field of Search ..... 164/30–32, 228, 164/302, 369–370; 249/175–186, 135

(56) References Cited

FOREIGN PATENT DOCUMENTS

DE 1 929 898 * 12/1970

* cited by examiner

*Primary Examiner*—Kuang Y. Lin
(74) *Attorney, Agent, or Firm*—Bachman & LaPointe, P.C.

(57) ABSTRACT

A method for casting a workpiece comprising the steps of applying a protective coating to a base core the base core comprising, a metal strip comprising a generally planar expanse, a plurality of tabs arranged in a pattern upon the metal strip each of the tabs comprising a base end, a terminus end, and a tab shaft extending from the base end to the terminus end wherein each of the tabs is angularly displaceable about each the base end of the tabs, injecting a molding substance about the tabs of the base core, encapsulating the base core in a shell, removing the molding substance, casting the base core, and removing the base core.

18 Claims, 2 Drawing Sheets

SHAPED CORE FOR CAST COOLING PASSAGES AND ENHANCED PART DEFINITION

BACKGROUND OF THE INVENTION (1) Field of the Invention

The present invention relates to a fabricated, refractory metal core and a method of using such a core for casting cooling passages. More specifically, this invention relates to a method of incorporating a refractory metal core comprised of movable tabs and base body into the casting process so as to provide a cast part with cooling passages and form definition.

(2) Description of Related Art

Several refractory metals including molybdenum (Mo) and Tungsten (W) have melting points that are in excess of typical casting temperatures of nickel and cobalt based superalloys. These refractory metals can be produced in wrought thin sheet or formed in sizes necessary to make cooling channels characteristic of those found in turbine and combustor cooling designs and other applications. Thin refractory metal sheets and foils possess enough ductility to allow bending and forming into complex shapes. To increase ductility, sheets and foils may be elevated in temperature. The ductility yields a robust design capable of surviving a waxing/shelling/casting cycle.

Since cooling channels formed from refractory metals provide for the dissipation and/or removal of heat in operative parts incorporating such channels, it is often times advantageous to provide the surface of such operative parts with a pattern of holes extending into the part from the outside or inside through the thickness of the part by which heat may be dissipated by accommodating cooling flow. Such a pattern of holes may be accomplished through post-processing operations including the laser drilling of cooling holes. Cooling channel/hole recast attributed to laser drilling and Electrical Discharge Machining (EDM) can contribute to premature crack formation and reduced durability/life. In addition, it is difficult to vary the cross-sectional geometry of the cooling passages created by such drilling. Because different regions of an operative part may experience different forces and heating properties, it would be preferable to be able to vary the cross-sectional geometries of the cooling passages drilled into different regions of a part.

In addition, the complex shapes of many parts result in regions which can prove difficult or impossible to reach by drilling and are therefore difficult to provide meaningful cooling presently. Such regions include, but are not limited to, spaces between attachment studs/hooks and the exposed surface of combustor panels, near rails, component edges, and grommets.

Also, tailored cooling is desirable. In addition to the potential for increased cooling efficiency, such tailoring provides the ability to tailor aerodynamic performance.

There therefore exists a need for a method of using refractory metal cores to cast parts possessing a surface pattern of cooling channels or holes through which heat may be dissipated. Ideally, the cross-sectional geometry of such holes should be configurable so that the heat dissipation and aerodynamic performance qualities of the holes generally correspond to the requirements of their location on a part. In addition, there exists a need to deposit such cooling channels in locations on a part whose geometry precludes drilling such holes.

SUMMARY OF THE INVENTION

Accordingly, it is an object of the present invention to provide a method for casting cooling passages in workpieces.

It is an additional object of the present invention to provide a base core for use in casting cooling passages into workpieces.

In accordance with the present invention, a method for casting a workpiece comprises the steps of applying a protective coating to a base core the base core comprising, a metal strip comprising a generally planar expanse, a plurality of tabs arranged in a repeating pattern upon the metal strip each of the tabs comprising a base end, a terminus end, and a tab shaft extending from the base end to the terminus end wherein each of the tabs is angularly displaceable about each base end of the tabs, injecting a molding substance about the tabs of the base core, encapsulating the base core in a shell, removing the molding substance, casting about the base core, and removing the base core.

In accordance with the present invention, a base core for use in casting cooling passages in a workpiece comprises a metal strip comprising a generally planar expanse, a plurality of tabs arranged in a pattern upon the metal strip each of the tabs comprising, a base end, a terminus end, and a tab shaft extending from the base end to the terminus end, wherein each of the tabs is capable of independent angular displacement about each the base end of the tabs and wherein the base core is bent to form a hard back core.

BRIEF DESCRIPTION OF THE DRAWINGS

FIG. 1(*b*) A diagram of an alternative preferred repeating pattern of tabs formed into a core of the present invention.

FIG. 1(*c*) Perspective illustration of a core of the present invention with the tabs angularly displaced.

DETAILED DESCRIPTION OF THE PREFERRED EMBODIMENT(S)

Figure 1A:
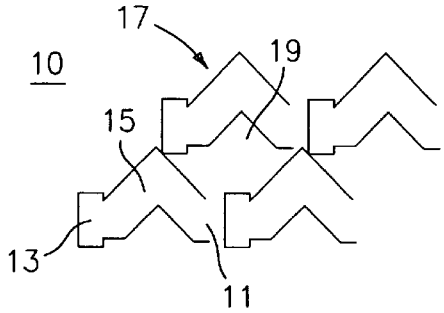
FIG. 1(*a*) A diagram of a preferred repeating pattern of tabs formed into a core of the present invention.

The base cores of the present invention differ from existing refractory metal cores used in casting processes in the respect that the base cores conform to the internal surface shape of a tooling die used in the preliminary stages of casting and provide structural strength and form during the shelling/casting process. Furthermore, as will be discussed more fully below, the base cores of the present invention are comprised of mechanically bent tabs which in turn form integrally cast cooling channels or cooling holes.

Structural hard-back cores may be formed of metal foils comprised of refractory metals subjected to a cutting operation. The cutting operation involves cutting a design into the metal foil via laser machining, photo or chemical etching, direct casting or forging, conventional machining, or punch pressing. In the present invention, a refractory core fashioned from such a metal foil is mechanically bent to mate with the curvature of a tooling die whose inner volume corresponds in shape to, but not limited to, combustor liners/panels/heat shields/fuel-air systems/turbine airfoils/vanes/air seals/endwalls/platforms, and gas turbine exhaust components. The refractory core so formed to mate with the tooling die forms the base core. This initial bending process can be performed prior to, in conjunction with, or following the cutting operation.

As a result of the cutting process, small tabs of geometrically regular shapes are cut in the base core to form finger-like negatives of cooling channels or holes. The base core serves as the structural member providing the curvature of the part. The fingers remain attached to the base core and are mechanically bent to form tabs or material extensions from the base core. These extensions henceforth form cooling passages or holes in the cast components. In a preferred embodiment, the tabs of the core are bent after bending the metal foil and prior to mating the base core with the tooling die. For conventional investment casting, the core is emplaced in the tooling prior to injecting mold material, such as wax, into the tool. The mold with core incorporated into the mold is then placed through the shelling process. The mold material is evacuated to form an empty housing within the shell to which the core remains attached.

During the final stage of the casting process, metal is poured or injected into the mold housing about the base core to form a part. The temperature of the metal injected may be of a temperature sufficient to partially oxidize the base core. Therefore, to prevent dissolution and oxidation of the refractory metal core, at elevated temperatures, e.g., during casting, a protective coating is applied to the core pre-form. In a preferred embodiment, protective coatings include, but are not limited to, ceramics. The present invention is drawn broadly to encompass any such coating effective to prevent dissolution and oxidation of the metal core during the casting process. This coating also provides the surface quality of the part and cooling passages/holes.

Figure 1B:
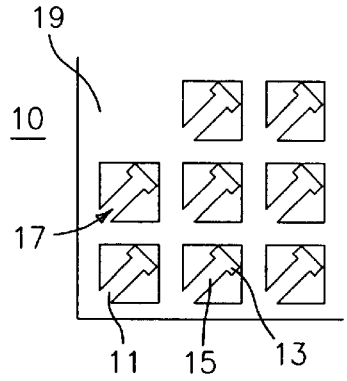
Figure 1C:
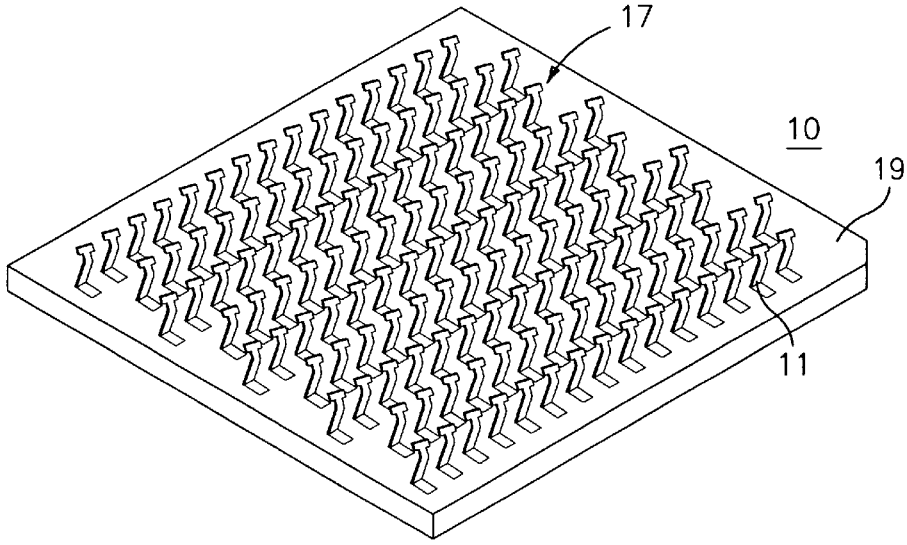

With reference to FIGS. 1(*a*)–(*b*), there is illustrated two preferred embodiments of a metal foil 19 forming the base core 10 of the present invention. Metal foil 19 is comprised of a plurality of tabs 17 arranged in a repeating pattern. Each tab 17 has a base end 11, a terminus end 13 and a tab shaft 15 extending from the base end 11 to the terminus end 13. Tab shafts 15 of FIG. 1(*a*) bend at an approximate right angle while the tabs 17 of FIG. 1(*b*) are generally linear in construction and extend primarily straight from base end 11 to terminus end 13. Because the tabs 17 can be angularly displaced about their base ends 11 to form cooling passages as described in greater detail below, the shape of the tabs 17 determines the geometry of, and hence the aerodynamic and heat transfer performance of, the cooling passages so formed. Therefore, while illustrated herein with respect to two preferred tab geometries, the present invention is broadly drawn to the inclusion of any tab geometry suitable to produce a cooling passage possessing desirable heat transfer characteristics and aerodynamic performance.

With reference to FIG. 1(*c*) there is illustrated a perspective view of base core 10 wherein each of the tabs 17 has been mechanically displaced or bent about its base ends 11. As a result, each tab shaft 15 extends away from the predominantly planar surface of the base core 10 in a generally uniform manner, although the present invention is not limited to such a uniform manner.

Equiax, directionally-solidified, and single-crystal nickel and cobalt super-alloys are typically used to form operative parts including, but not limited to, combustor liner panels and hot-section turbine component castings. Conventionally, these components are investment (or negative-gravity) or controlled-solidification cast using wax positives made in tooling dies. The tooling dies are machined aluminum (or alternative material) with compensation for shrinkage, gating, and venting. The tooling dies are sealed and injected with a molding substance, typically wax, to form the part. The tooling die is then removed and the wax part is subsequently built-up with pre-coat and shelling material/stucco to form a shell around the operative part. The wax is evacuated from the shell to form the mold for the metal part.

In the present invention, the tooling die is modified and grown in size to accommodate the coated base core. In a preferred embodiment, the base core is situated in the tooling die so as to rest generally flush with an inner surface of the tooling die and the wax is injected about the base core. For accurate placement, the tooling die may also be modified to have datum/attachment pins or holes to secure the base core in the tooling die. Alternative methods of fabricated wax parts molds, including rapid prototype means, can also be adjusted to accommodate these base cores. Conventional cores may also be incorporated into the tooling die in conjunction with this type of base core. Following the casting procedure, the core will be removed by chemical removal, thermal leaching, or oxidation methods.

Figure 2:
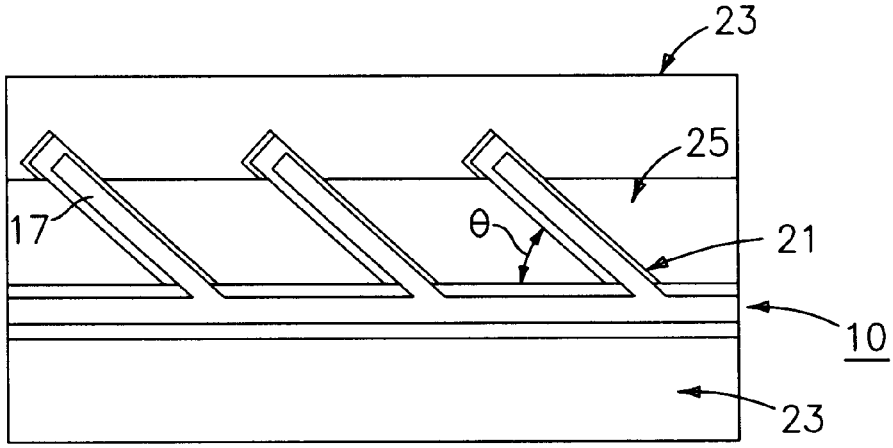
FIG. 2 A cross-section diagram of a core of the present invention prior to casting.

With reference to FIG. 2, there is illustrated a cross-sectional view of the base core 10 of the present invention after removal from the tooling die and the subsequent shelling procedure but prior to casting. As illustrated, each tab 17 is angularly displaced from the base core 10 by an angle theta. There is applied to the surface of base core 10 a protective coating 21. Protective coating 21 is applied to base core 10 prior to any bending of the base core 10 to mate with the tooling die. Protective coating 21 prevents the dissolution and oxidation of the refractory metal core 10, particularly at elevated temperatures encountered during casting, as well as provides a desired surface quality of the part.

Base core 10 is of sufficient rigidity to function as a structural hard back-core. As used herein, "hard back-core" refers to a component which gives shape and structural support during the casting process. As such, the base core 10 of the present invention can function as a hard back core. In a preferred embodiment, base core 10 is mated to the inner surface of a tooling die while molding substance is injected into the tooling die to cover the inward facing surface of the base core 10. A preferred molding substance is wax but may be any substance capable of holding its form during the shelling process and capable of removal thereafter. The molding substance is injected to form molding layer 25 in such a manner as to surround each tab 17 while allowing each tab 17 to extend through molding layer 25.

After the molding substance has been injected and allowed to harden, the molding substance is removed from the tooling die. The coated base core 10 and the surrounding molding layer 25 is subsequently built-up with pre-coat and shelling material/stucco layers to form a shell 23 around the operative part, after which the shell may be hardened, e.g., by heating. The molding layer 25 is then evacuated from the shell 23 to form the mold for the operative part. Metal is then injected into the evacuated shell 23 and the shell 23 removed resulting in a cast operative part in contact with the base core 10 and through which protrudes a plurality of tabs 17.

Figure 3:
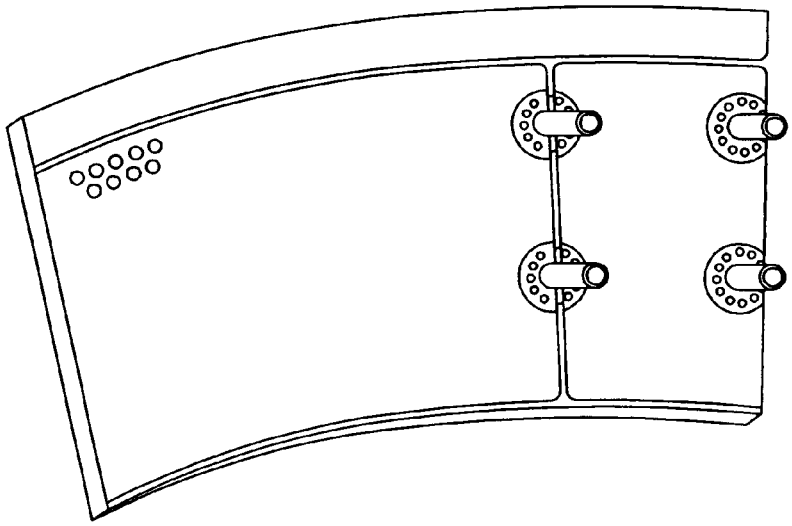
FIG. 3 A perspective schematic diagram of a post-casting core of the present invention.

With reference to FIG. 3, there is illustrated a perspective view of a post-casting operative part after core removal. Once the base core is removed through a process of chemical removal, thermal leaching, or oxidation, (or other applicable means sufficient to remove the base core) the volume of space previously occupied by the bent tabs form cooling passages through which heat may be dissipated and removed by coolant. As noted above, by changing the geometry of the tabs as they are cut into the metal foil when forming the base core, it is possible to vary the cross sectional characteristics of the cooling passages and, hence, to change the heat transfer and aerodynamic performance characteristics of the cooling passages. The thickness of the core applies another degree of freedom in specifying the cooling hole/passage shape and dimensions.

The cores in this invention can be tailored to meet performance requirements of a particular component design. In this respect, cores can be very small, thin, shaped, and the tabs bent to optimize cooling performance as well as to control flow losses/discharge coefficients. Tabs can be arranged in a repeatable, prescribed or tailored configuration at densities and orientation commensurate with requirements of cooling the cast part. This can reduce cooling requirements and alleviate material temperature requirements. In addition, the bent tab features allow cooling to be incorporated at locations that are difficult to cool presently. Such locations include, but are not limited to, spaces between attachment studs/hooks and the exposed surface of combustor panels; near rails, component edges, and grommets.

As a result of the core being incorporated directly into the casting process, the advantages resulting from the cooling passages are inherent to the operative part and post-processing operations including laser drilling of cooling holes are no longer needed or are streamlined. Likewise, cooling channel/hole recast attributed to laser drilling and EDM, which can contribute to premature crack formation and reduced durability/life, is eliminated.

In addition, with an automated core forming process, the consistency of the hole shapes is also improved. Finally, the core provides strength and form during shelling. As a result, part shapes and tolerances are better maintained during casting, so yields are improved and post-casting part rework is eliminated.

It is apparent that there has been provided in accordance with the present invention a method of incorporating a refractory metal core comprised of movable tabs into the casting process so as to provide a cast part with cooling passages which fully satisfies the objects, means, and advantages set forth previously herein. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A base core for use in casting cooling passages in a workpiece comprising:

a metal strip comprising a generally planar expanse;

a plurality of tabs arranged in a pattern upon said metal strip each of said tabs comprising:

a base end;

a terminus end; and a tab shaft extending from said base end to said terminus end;

wherein each of said tabs is independently angularly displaceable about each said base end of said tabs and wherein said base-core is bent to form a hard back core.

2. The base core of claim 1, wherein said tab shafts extends in a generally linear manner.

3. The base core of claim 1, wherein said tab shafts extends from one of said base ends to a corresponding one of said terminus ends in a non-linear manner.

4. The base core of claim 1, wherein said metal strip comprises a refractory metal.

5. The base core of claim 4, wherein said refractory metal is selected from the group consisting of molybdenum and tungsten.

6. The base core of claim 1, wherein said tabs are formed via laser machining.

7. The base core of claim 1, wherein said tabs are formed by photoetching.

8. The base core of claim 1, wherein said tabs are formed by chemical etching.

9. The base core of claim 1, wherein said tabs are formed by direct casting.

10. The base core of claim 1, wherein said tabs are formed by machining.

11. The base core of claim 1, wherein said tabs are formed by punch pressing.

12. The base core of claim 1, wherein said workpiece is selected from the group consisting of turbines, combustors liners, panels, heat shields, fuel-air systems, turbine airfoils, vanes, air seals, endwalls, platforms, and gas turbine exhaust components.

13. A method for casting a workpiece comprising the steps of:

applying a protective coating to a base core said base core comprising:

a metal strip comprising a generally planar expanse;

a plurality of tabs arranged in a pattern upon said metal strip each of said tabs comprising:

a base end;

a terminus end; and a tab shaft extending from said base end to said terminus end;

wherein each of said tabs is angularly displaced about each said base end of said tabs;

injecting a molding substance about said tabs of said base core;

encapsulating said base core along with the molding substance in a shell;

removing said molding substance;

casting molten metal about said base core; and removing said base core.

14. The method of claim 13 comprising the additional steps of:

mating said base core with a surface of a tooling die prior to said injecting of said molding substance; and removing said base core along with said molding substance from said tooling die after said injecting step.

15. The method of claim 14 comprising the additional step of bending said base core to fit flush with said surface of said tooling die.

16. The method of claim 15 comprising the additional step of securing said base core to said surface of said tooling die using attachment pins.

17. The method of claim 13, wherein said base core forms a hard back core.

18. The method of claim 13, wherein said workpiece is selected from the group consisting of turbines, combustors liners, panels, heat shields, fuel-air systems, turbine airfoils, vanes, air seals, endwalls, platforms, and gas turbine exhaust components.

* * * * *

UNITED STATES PATENT AND TRADEMARK OFFICE

CERTIFICATE OF CORRECTION

PATENT NO. : 6,668,906 B2
DATED : December 30, 2003
INVENTOR(S) : Steven W. Burd It is certified that error appears in the above-identified patent and that said Letters Patent is hereby corrected as shown below:

Column 5,
Lines 61-62, "and wherein said base core is bent to form a hard back core" should be deleted.

Signed and Sealed this

Seventh Day of September, 2004

JON W. DUDAS
*Director of the United States Patent and Trademark Office*